US006836914B1

(12) United States Patent
Tsai

(10) Patent No.: US 6,836,914 B1
(45) Date of Patent: Jan. 4, 2005

(54) AIR-CUSHIONED BED WITH BUILT IN AIR BLOWER

(76) Inventor: Lung-Po Tsai, 27F, No. 29-3, Sec. 2, Chung-Cheng E. Rd., Tan-Shui Chen, Taipei Hsien (TW)

( * ) Notice: Subject to any disclaimer, the term of this patent is extended or adjusted under 35 U.S.C. 154(b) by 34 days.

(21) Appl. No.: 10/608,401

(22) Filed: Jun. 27, 2003

(51) Int. Cl.[7] ..... A47C 27/08
(52) U.S. Cl. ..... 5/713; 5/706; 5/655.3
(58) Field of Search ..... 5/655.3, 706, 710, 5/713

(56) References Cited

U.S. PATENT DOCUMENTS 5,367,726 A * 11/1994 Chaffee ..... 5/706
6,332,760 B1 * 12/2001 Chung ..... 417/411
6,543,073 B2 * 4/2003 Wu ..... 5/713
6,550,086 B2 * 4/2003 Boyd ..... 5/706
2002/0194678 A1 * 12/2002 Chung ..... 5/713

* cited by examiner

*Primary Examiner*—Teri Pham Luu
(74) *Attorney, Agent, or Firm*—Alan D. Kamrath; Nikolai & Mersereau, P.A.

(57) ABSTRACT

An air-cushioned bed assembly includes an air bed with a concave space defined in a side face thereof, a casing received in the concave space and securely connected to the side face of the air bed. The casing has a body with a U-shaped cross section, a through hole defined in a side face of the body and a cover foldably connected to a circumference defining the through hole. An air blower is detachably received in the body of the casing and has an inlet and an outlet corresponding to the through hole of the body. A securing device is securely formed in the body to selectively retain the air blower inside the casing. Activation of the air blower facilitates air flowing into the air bed via the through hole, which folds the cover.

9 Claims, 5 Drawing Sheets

AIR-CUSHIONED BED WITH BUILT IN AIR BLOWER

BACKGROUND OF THE INVENTION

1. Field of the Invention

The present invention relates to an air blower inside an air-cushioned bed, and more particularly to a built-in air blower inside the bed to inflate or deflate the air-cushioned bed.

2. Description of Related Art

A conventional air-cushioned bed has a large air cell with air contained therein. Due to the cushion effect provided by the air in the air cell, the user lying on the air-cushioned bed is able to have excellent support. In order to facilitate the inflation and deflation of the air cell, the air cell is provided with an air nozzle communicating the interior of the air cell with surrounding air. The user is able to use an air compressor or the like to inflate or deflate the air cell via the air nozzle.

However, it is well known in the art that even if the size of the air compressor is small, it is hard for the user to prepare a storing space for the air compressor. Furthermore, because airbeds tend to used infrequently, such as once or twice in the summer, it is easy for the compressor to become hidden from view by other things stored.

To overcome the shortcomings, the present invention tends to provide an improved air-cushioned bed to mitigate the aforementioned problems.

SUMMARY OF THE INVENTION

The primary objective of the present invention is to provide an improved air-cushioned bed with a built-in air blower so that additional space otherwise needed for storing the air blower is saved.

Another objective of the present invention is that the air blower is detachably received in a container such that either inflation or deflation of the air cell of the air-cushioned bed is easily accomplished.

Other objects, advantages and novel features of the invention will become more apparent from the following detailed description when taken in conjunction with the accompanying drawings.

DETAILED DESCRIPTION OF THE PREFERRED EMBODIMENT

Figure 1:
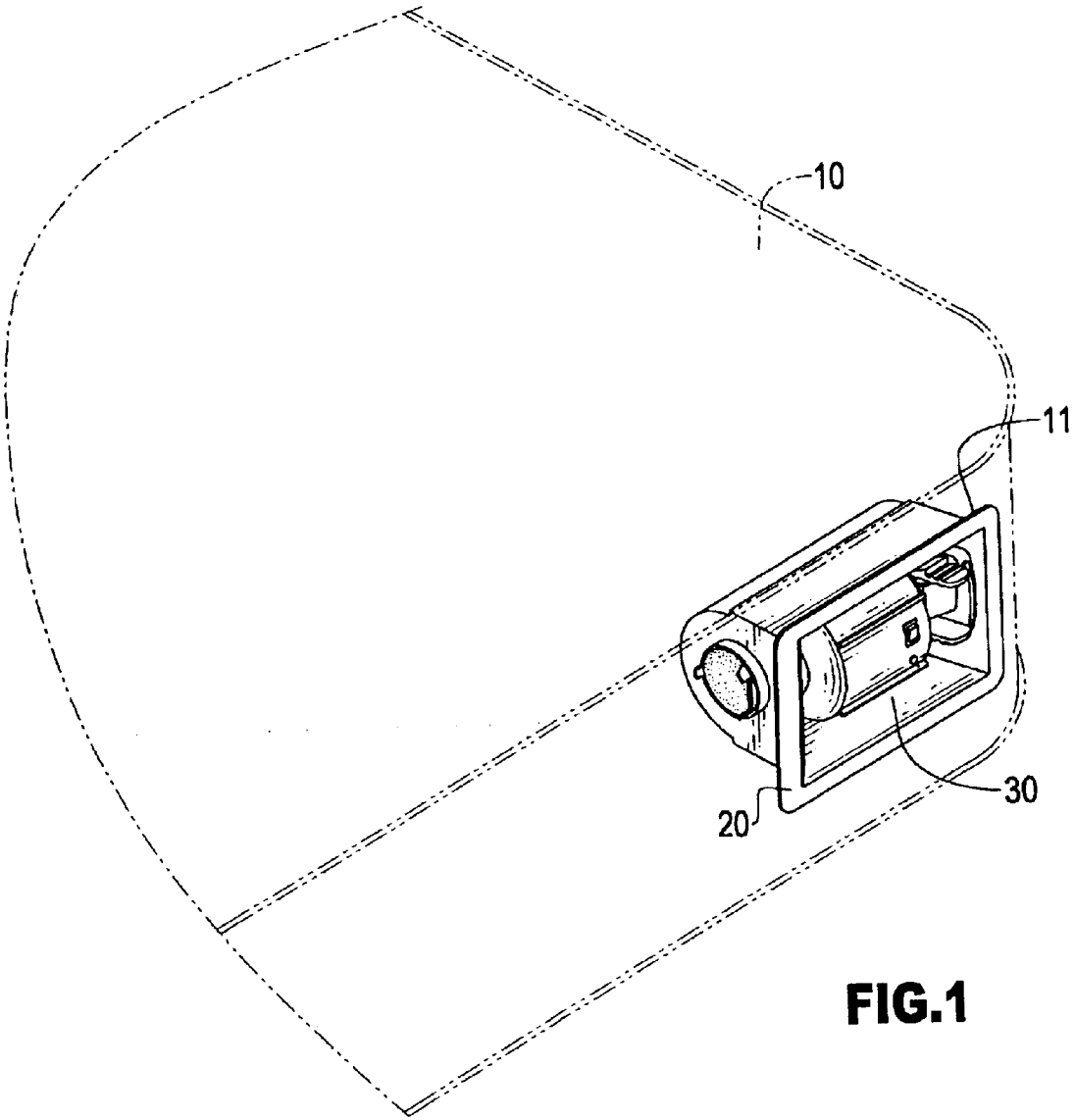
FIG. 1 is a schematic perspective view showing that an air blower is received in an air-cushioned bed of the present invention.

With reference to FIG. 1, the air-cushioned bed (10) of the present invention includes a concave space (11) defined in a side face of the air-cushioned bed (10), a casing (20) and an air blower (30) received inside the casing (20).

Figure 2:
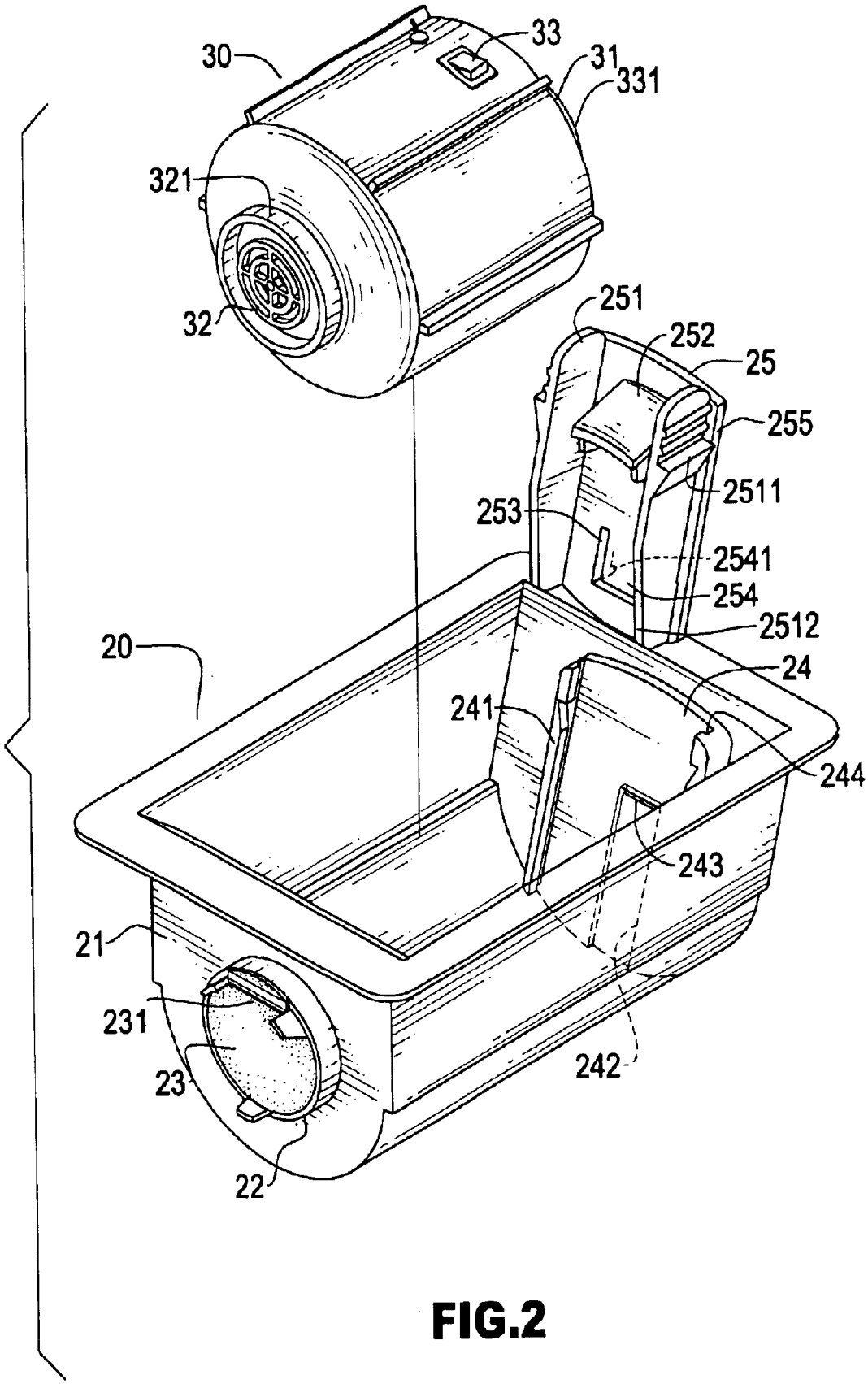
FIG. 2 is an exploded perspective view showing the relation between the air blower and a casing.

With reference to FIG. 2, it is noted that the air blower (30) is capable of sucking air from surrounding atmosphere into an inlet (31) and blowing air out of the air blower (30) from an outlet (32). The inlet (31) has a first annular flange (311) and the outlet (32) has a second annular flange (321). Further the air blower (30) has a switch (33) mounted on an outer surface of the air blower (30) to control activation and deactivation of the air blower (30). The internal structure of the air blower (30) is not the subject of the application such that detailed description thereof is omitted.

The casing (20) has a U-shaped cross section and includes a body (21), a through hole (22) defined in a side face of the body (21), a cover (23) pivotally connected to a circumference defining the through hole (22) to optionally plug the through hole (22), a sliding seat (24) formed on an inner side face of the body (21) and opposite to the through hole (22), and a position plate (25) slidable with respect to the sliding seat (24).

The cover (23) preferably is made of a resilient material so that the cover (23) is deformable when receiving a force. Besides, the cover (23) has a groove (231) defined in an upper portion thereof so that when the cover (23) is receiving a force, the cover (23) is folded along the groove (231) to open the through hole (22).

The sliding seat (24) includes two oppositely formed ledges (241) each having a notch (2411) defined therein, a recessed area (242) centrally formed on the sliding seat (24) and a limiting groove (243) defining in a top portion of a bottom face defining the recessed area (242). Two tracks (244) respectively formed between one of the two ledges and a top face of the sliding seat (24).

The position plate (25) includes two oppositely formed side walls (251) each having a position ear (2511) integrally extending out therefrom to correspond to the notches (2411) and a truncated edge (2512) formed on a lower portion of the side wall (251), a cap (252) formed between the two side walls (251), a U-shaped cut (253) defined in a lower portion of the position plate (25) to form therein a tongue (254) which has two bosses (2541) oppositely formed on a rear side face of the tongue (254) to correspond to the limiting groove (243). It is noted that the position plate (25) has two extensions (255) oppositely formed on the position plate (25) to correspond to the tracks (244) of the sliding seat (24).

It is to be noted that the body (20) has a flange (200) which is to be securely connected to a side face of the air-cushioned bed by any appropriate method known in the art. Therefore, when the body (21) is received in the concave space (11) (as shown in FIG. 1), the connection between the flange (200) of the body (21) and the side face of the air-cushioned bed (10) is air tight and the through hole (22) communicates with the interior of the air-cushioned bed.

Figure 3:
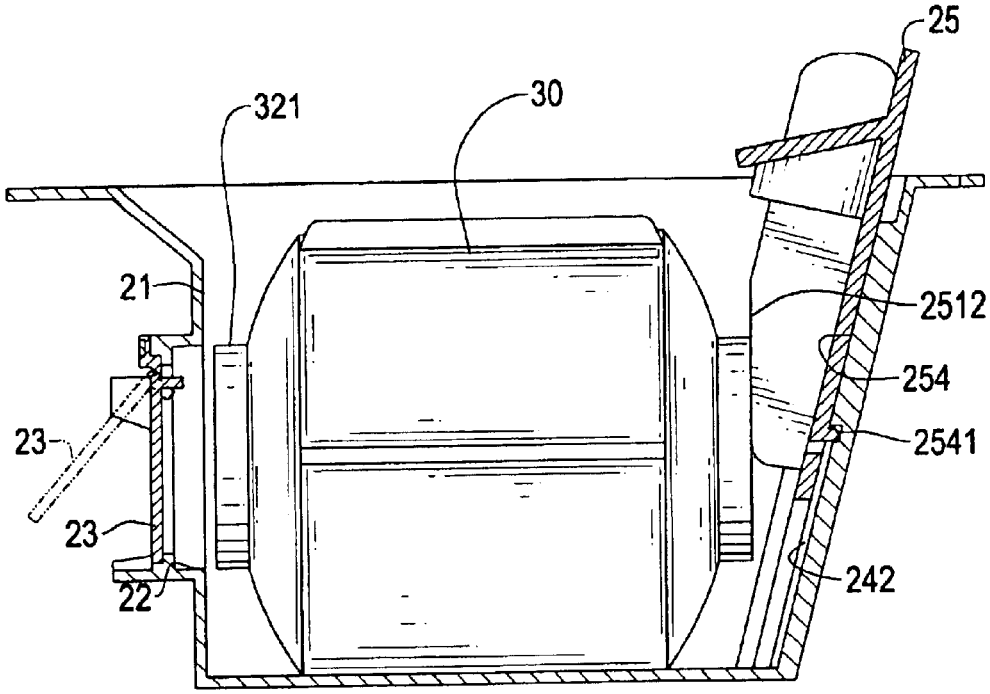
FIG. 3 is a schematic side plan view in partial section to show relationship between the position plate and the air blower inside the casing.
Figure 4:
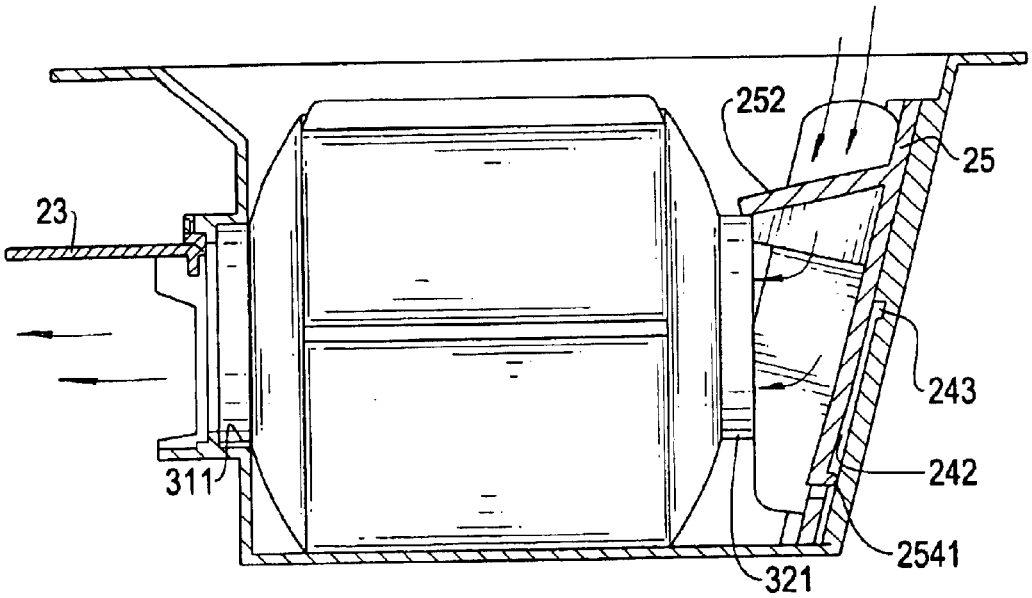
FIG. 4 is a schematic side plan view showing that the air blower is securely clamped by the position plate inside the casing.
Figure 5:
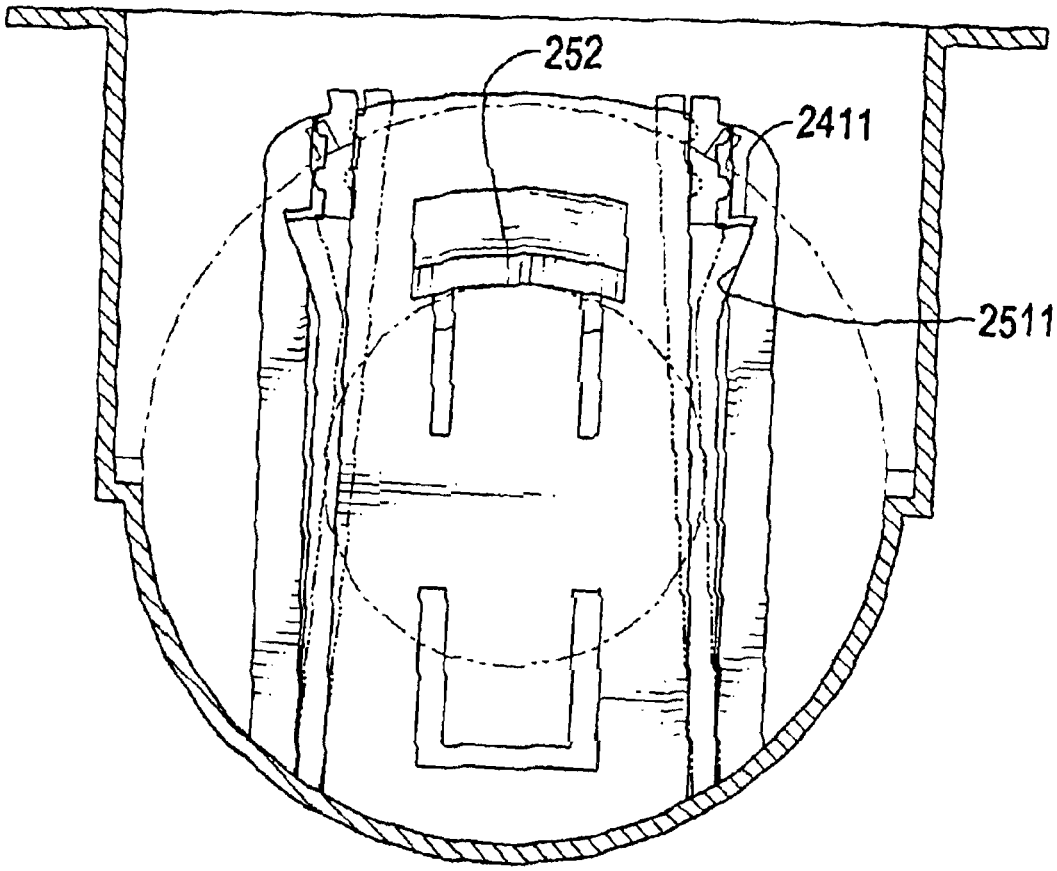
FIG. 5 is a schematic side plan view showing the relationship between the position plate and the casing.

With reference to FIGS. 3 and 4 and still taking FIG. 2 for reference, after the air blower (30) is received in the body (21) and after the position plate (25) is connected to the sliding seat (24), the movement of the two extensions (255) along the corresponding tracks (244) allows the position plate (25) to slide into the body (21). Furthermore, the sliding seat (24) is so defined that when the position plate (25) is moved downward into the body (21), the tongue (254) is slightly abutted by the bottom face of the recessed area (242) due to the bosses (2541). Due to the design of the recessed area (242), as the position plate (25) continues to move downward into the body (21), the tongue (254) will be slightly tilted. In the meantime, while the position plate (25)

is moving downward into the body (21), the truncated edge (2512) engages with the first annular flange (311) and gradually pushes the air blower (30) to allow the second annular flange (321) to be received in the through hole (22). In order to accomplish a secure engagement of the second annular flange (321) and an inner face defining the through hole (22), the through hole (22) has a diameter slightly larger than that of the second annular flange (321) such that after the second annular flange (321) is received in the through hole (22) due to the push of the truncated edge (2512) to the first annular flange (311) of the air blower (30), the engagement therebetween is secured. After the position plate (25) is moved to reach a bottom face of the body (21), the cap (252) engages with the first annular flange (311) and the two position ears (2511) of the two side walls (251) are received in the corresponding notches (2411) to therefore position the air blower (30) inside the body (21), as shown in FIG. 5. It is to be noted that after the air blower (30) is securely received inside the body (21) and activated, the air flow from the air blower (30) moves the cover (23), which is shown in the dashed lines shown in FIG. 3. However, when the bed is to be deflated, the operator reverses the air blower (30) and still uses the cap (252) to position the air blower (30) inside the body (21). Because the inlet (31) is now in alignment with the cover (23), in order to suck the air from the bed, the operator has to move the cover (23) upward to allow the inlet (31) to communicate with the interior of the bed such that air is able to be sucked from the bed.

Figure 6:
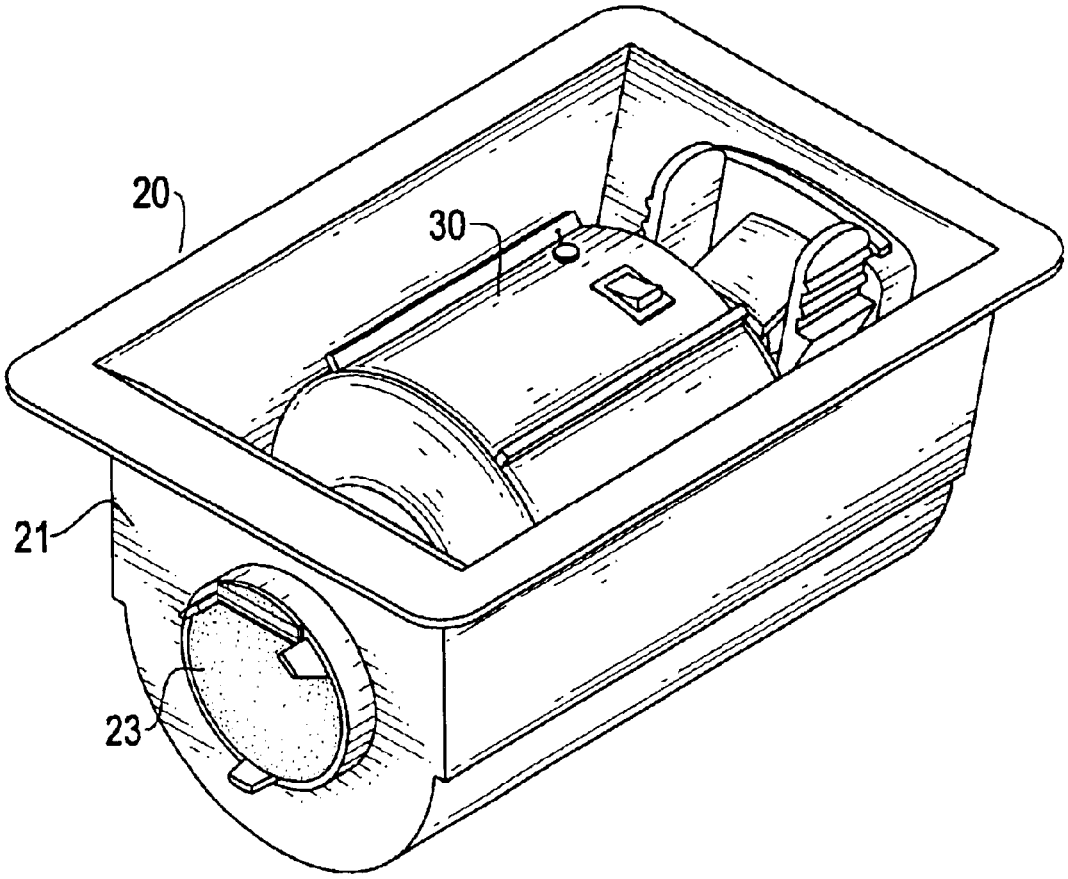
FIG. 6 is a perspective view showing that the air blower is securely positioned inside the casing.

With reference to FIG. 6 and still using FIG. 5 for reference, after the air blower (30) is securely received in the body (21), the air blower (30) is able to inflate the air-cushioned bed (10) (in FIG. 1). It is noted that when the air blower (30) is inflating the air-cushioned bed (10), the cover (23) is blown and folded at the groove (231) so that air is able to be forced into the air-cushioned bed (10).

However, when the air-cushioned bed (10) is to be deflated, the user may force the two side walls (251) (as shown in FIG. 5) to move toward each other such that the position ears (2511) may leave the limitation of the notches (2411). Then the user may pull the position plate (25) upward to release the air blower (30). After the air blower (30) is released and removed from the casing (20), the user may reversibly place the air blower (30) back into the casing (20). That is, the inlet (31) will be facing the through hole (22) and the outlet (32) will be facing the sliding seat (24). Thereafter, the secure process to the air blower (30) by the position plate (25) is the same as what is disclosed above. The activation of the air blower (30) sucks air out of the air-cushioned bed (10) to rapidly deflate the air-cushioned bed (10).

In conclusion, with the casing (20) received in the concave space (11) in the air-cushioned bed (10) and the air blower (30) detachably received in the casing (20), the user can easily store the air blower (30) without occupying any further space than that occupied by the air-cushioned bed. Because the air blower (30) is secured by the position plate (25) inside the body (21) of the casing (20), the user need not worry that the air blower (30) will be lost due to movement of the bed, or buried under piles of clothes around the bed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air-cushioned bed assembly comprising:

an air bed with a concave space defined in a side face thereof;

a casing received in the concave space and securely connected to the side face of the air bed in an air tight manner, the casing having a body with a U-shaped cross section, a through hole defined in a side face of the body, a cover foldably connected to a circumference defining the through hole;

an air blower detachably received in the body of the casing, the air blower having an inlet and an outlet corresponding to the through hole of the body; and a securing device securely formed in the body to selectively retain the air blower inside the casing, thereby activation of the air blower facilitates air flowing into the air bed via the through hole, which folds the cover.

2. The air-cushioned bed assembly as claimed in claim 1, wherein the cover has a groove defined in a top portion of the cover so that when the cover is moved by the air flowing from the air blower, the cover is folded from the groove.

3. The air-cushioned bed assembly as claimed in claim 1, wherein the securing device comprising:

a sliding seat with two oppositely defined tracks each provided with a notch defined therein, a recessed area defined between the two tracks; and a position plate slidably connected to the sliding seat along the tracks and having two position ears respectively and oppositely formed on a side wall and a cap formed between the two side walls to engage and secure the air blower inside the body after the two position ears are received in the two notches.

4. The air-cushioned bed assembly as claimed in claim 2, wherein the securing device comprising:

a sliding seat with two oppositely defined tracks each provided with a notch defined therein, a recessed area defined between the two tracks; and a position plate slidably connected to the sliding seat and having two position ears respectively and oppositely formed on a side wall and a cap formed between the two side walls to engage and secure the air blower inside the body after the two position ears are received in the two notches.

5. The air-cushioned bed assembly as claimed in claim 4, wherein a limiting groove is defined in a top portion of the recessed area, the position plate has a U-shaped cut to form a tongue having two opposite bosses formed to correspond to limiting groove.

6. The air-cushioned bed assembly as claimed in claim 3, wherein each side wall has a truncated edge formed on a lower portion thereof such that when the position plate is moved along the tracks, the two truncated edges of the two side walls engage with the air blower to force the outlet of the air blower to be received in the through hole.

7. The air-cushioned bed assembly as claimed in claim 4, wherein each side wall has a truncated edge formed on a lower portion thereof such that when the position plate is moved along the tracks, the two truncated edges of the two side walls engage with the air blower to force the outlet of the air blower to be received in the through hole.

8. The air-cushioned bed assembly as claimed in claim 5, wherein each side wall has a truncated edge formed on a lower portion thereof such that when the position plate is moved along the tracks, the two truncated edges of the two side walls engage with the air blower to force the outlet of the air blower to be received in the through hole.

9. The air-cushioned bed assembly as claimed in claim 8, wherein a bottom face defining the recessed area is tilted so that when the tongue is moved along the recessed area, the tongue is abutted by the bottom face of the recessed area due to the bosses and the bosses will be received in the limiting groove while removing the air blower out of the body.

* * * * *